US005332157A

United States Patent [19]

Proctor

[11] Patent Number: 5,332,157

[45] **Date of Patent: * Jul. 26, 1994**

[54] HAND OPERATED FLUID DISPENSER FOR MULTIPLE FLUIDS AND DISPENSER BOTTLE

[75] Inventor: Rudy R. Proctor, Anaheim, Calif.

[73] Assignee: Take 5, Anaheim, Calif.

[ * ] Notice: The portion of the term of this patent subsequent to Oct. 6, 2009 has been disclaimed.

[21] Appl. No.: 865,001

[22] Filed: Apr. 8, 1992

Related U.S. Application Data

[63] Continuation-in-part of Ser. No. 591,526, Oct. 1, 1990, Pat. No. 5,152,461.

[51] Int. Cl.[5] ..... B05B 7/04; B05B 9/043; B05B 11/00

[52] U.S. Cl. ..... 239/304; 239/333; 222/136; 222/145

[58] Field of Search ..... 239/303, 304, 305, 331, 239/333, 334; 222/136, 145, 340, 383

[56] References Cited

U.S. PATENT DOCUMENTS

| | | | |
|---|---|---|---|
| D. 186,734 | 11/1959 | Zapolski | D62/2 |
| D. 325,519 | 4/1992 | Proctor | D9/372 |
| 1,059,611 | 4/1913 | Jordan . | |
| 1,517,496 | 12/1924 | Dee et al. . | |
| 2,200,875 | 5/1940 | Edwards et al. | 18/2 |
| 2,504,117 | 4/1950 | Downs | 117/104 |
| 2,513,081 | 6/1950 | Clark et al. | 299/140 |
| 2,560,761 | 7/1951 | Ferguson | 220/23.4 |
| 3,225,951 | 12/1965 | Poston | 215/6 |
| 3,575,319 | 4/1971 | Safianoff | 222/135 |
| 3,701,478 | 10/1972 | Tada | 239/333 |
| 3,768,734 | 10/1973 | Anderson et al. | 239/333 |
| 3,786,963 | 1/1974 | Metzler, III | 222/136 |
| 3,797,749 | 3/1974 | Tada | 239/321 |
| 3,889,834 | 6/1975 | Harris, Jr. | 215/10 |
| 3,897,006 | 7/1975 | Tada | 239/333 |
| 3,955,715 | 5/1976 | Topor | 222/143 |
| 3,980,231 | 9/1976 | Trondsen | 239/61 |
| 4,013,228 | 3/1977 | Schneider | 239/401 |
| 4,165,812 | 8/1979 | Jennison | 215/10 |
| 4,335,837 | 6/1982 | Bono | 222/137 |
| 4,355,739 | 10/1982 | Vierkötter | 222/136 X |
| 4,480,768 | 11/1984 | Martin | 222/341 |
| 4,573,595 | 3/1986 | Mednis | 215/10 |
| 4,713,064 | 12/1987 | Bruno et al. | 604/257 |
| 4,826,052 | 5/1989 | Micallef | 222/321 |
| 4,883,251 | 11/1989 | Manas | 249/53 R |
| 4,991,778 | 2/1991 | Maas et al. | 239/333 |
| 5,002,199 | 3/1991 | Frahm | 220/670 |
| 5,009,342 | 4/1991 | Lawrence et al. | 222/136 |

FOREIGN PATENT DOCUMENTS

| | | | |
|---|---|---|---|
| 1104531 | 7/1981 | Canada . | |
| 2115726 | 10/1971 | Fed. Rep. of Germany | 239/304 |

*Primary Examiner*—Andres Kashnikow
*Assistant Examiner*—William Grant
*Attorney, Agent, or Firm*—Lyon & Lyon

[57] ABSTRACT

A fluid-dispensing device which selectively draws fluid out from at least two containers or fluid chambers, mixes the fluids in a desired concentration or ratio and expels the mixture of fluids out a nozzle. The dispensing device may be equipped with a mechanism for variably controlling the ratio of the fluids being mixed. The containers may be bottles connectable to the fluid-dispensing device and selectively detachable for refilling with fluid or exchanging one of the containers with another container having an alternate fluid. The bottles include mating elements to permit interconnection of the bottles as well as venting and spill prevention mechanisms.

19 Claims, 11 Drawing Sheets

FIG. 30.
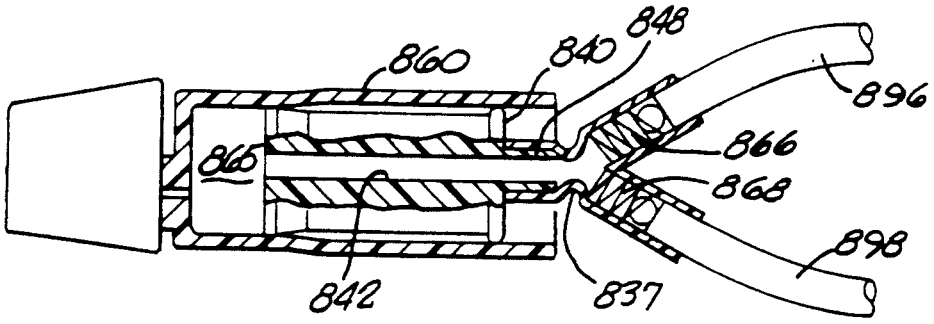
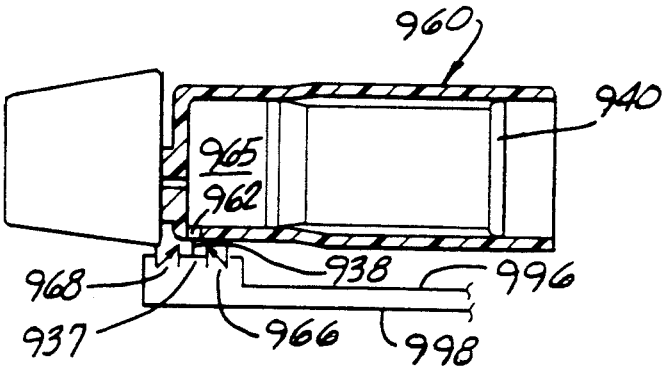
FIG. 31.
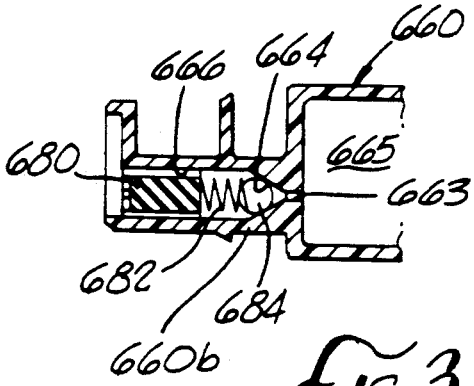
FIG. 32.
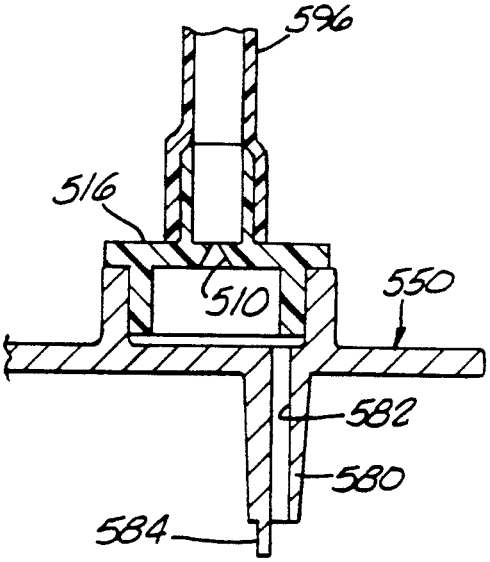
FIG. 33.

FIG. 34.
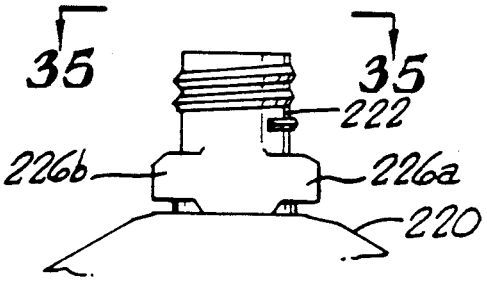
FIG. 37.
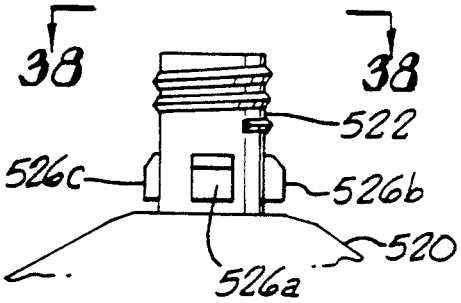
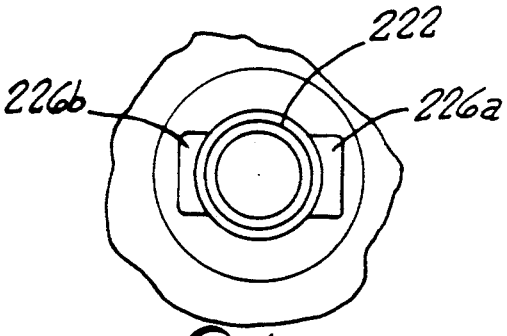
FIG. 35.
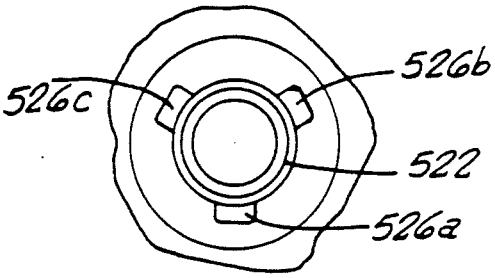
FIG. 38.
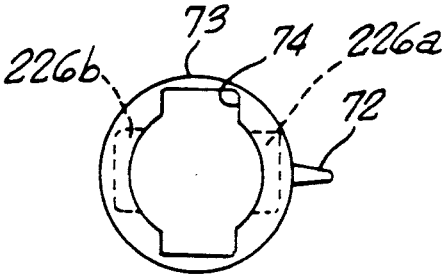
FIG. 36.
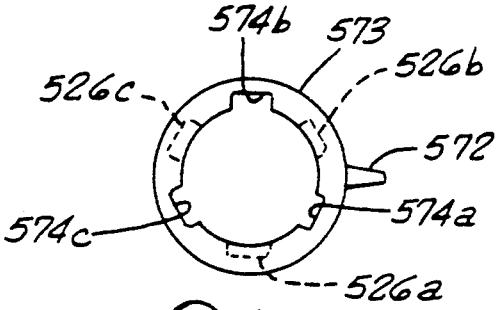
FIG. 39.

HAND OPERATED FLUID DISPENSER FOR MULTIPLE FLUIDS AND DISPENSER BOTTLE

RELATED APPLICATIONS

This application is a continuation-in-part of U.S. application Ser. No. 07/591,526 filed Oct. 1, 1990 now U.S. Pat. No. 5,152,461.

BACKGROUND OF THE INVENTION

The field of the present invention relates to devices for ejecting or spraying a fluid stream or spray through a nozzle from out of a container or bottle.

Heretofore there have been various hand-held sprayers such as that disclosed in U.S. Pat. No. 3,749,290 in which fluid from a container is pumped out by a pump mechanism comprised of a collapsible tubular bulb, the actuation of the trigger compressing the bulb to expel the fluid. Another type of trigger sprayer device is disclosed in U.S. Pat. No. 4,013,228 in which the trigger actuates the piston and cylinder combination which alternately draws fluid in from the container and then expels it out through a nozzle. U.S. Pat. Nos. 4,355,739 (Vierkötter) and 3,786,963 (Metzler) disclose hand pump devices which claim to disperse a mixture of two fluids from two fluid sources. These devices however require the two fluids to be mixed far from the pumping chamber which provides opportunity for the fluids to separate rather than staying mixed. In the application where the device varies the fluid concentration and a new concentration is selected, a large amount of fluid must be first expelled before fluid of the new concentration is expelled. In an application where the fluid is activated by mixing action, mixed fluid which is not expelled may become inactive in time.

The present inventor however is aware of no successful handheld device on the market, other than his own, which can reliably draw a plurality of fluids from a plurality of fluid sources and eject the fluid mixture at a desired concentration. The vast majority of all trigger-type sprayer devices are sprayers which draw fluid from a single container, the sprayer ejecting only that particular fluid and fluid concentration which is within the container.

SUMMARY OF THE INVENTION

The present invention relates to a fluid-dispensing device, in the preferred embodiment a trigger sprayer, which selectively draws fluid out from at least two containers or fluid chambers, mixes the fluids in a desired concentration or ratio and expels the mixture of fluids out a nozzle.

In a preferred embodiment the dispensing device is equipped with a means for variably controlling the ratio of the fluids being mixed. In another preferred embodiment, the containers or bottles connected to the sprayer device are selectively detachable for refilling a container with fluid or exchanging one of the containers with another container having an alternate fluid, the two bottles including venting and spill prevention mechanisms.

In another embodiment the fluid selection control device is included for permitting operative selection of one, two or more containers.

BRIEF DESCRIPTION OF THE DRAWINGS

FIG. 30 is a cross sectional view of another alternate pump design having dual check valves and a "Y" connector connecting through the piston;

FIG. 31 is a cross sectional view of another alternate pump design having with dual check valves and a "Y" connector externally connecting to the pump chamber;

FIG. 32 is a cross sectional view of a portion of the fluid path including an alternate metering device;

FIG. 33 is a cross sectional view of an alternative check valve design downstream of the pump mechanism;

FIG. 34 is a side elevation view of the neck portion of the bottle of FIG. 1;

FIG. 35 is a top plan view of the bottle of FIG. 34;

FIG. 36 is a plan view of the collar connecting element corresponding to the bottle of FIG. 35;

FIG. 37 is a side elevation view of the neck portion of an alternate bottle design;

FIG. 38 is a top plan view of the bottle of FIG. 37; and

FIG. 39 is a plan view of the collar connecting element correspponding to the bottle of FIG. 37.

DETAILED DESCRIPTION OF PREFERRED EMBODIMENTS

The preferred embodiments of the present invention will now be described with reference to the drawings. To facilitate description, any identifying numeral representing an element in one figure will represent the same element in any other figure.

Figure 1:
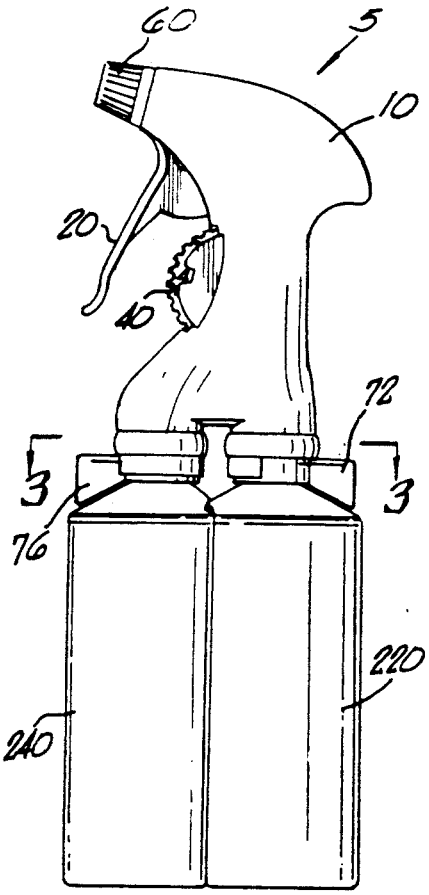
FIG. 1 is a side elevation view of a two-container trigger sprayer according to the preferred embodiment of the present invention.
Figure 2:
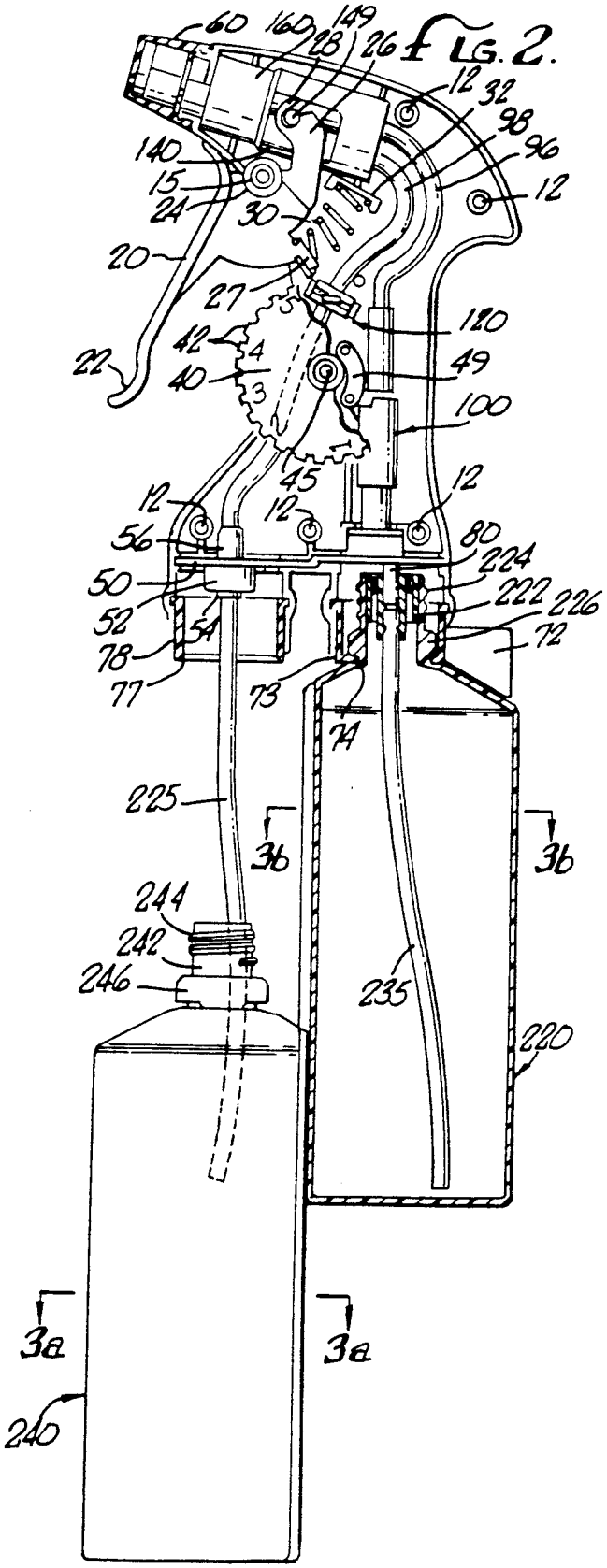
FIG. 2 is the spray and bottle combination of FIG. 1 in a partial cut-away view illustrating the internal mechanisms.

FIGS. 1-16 illustrate a preferred embodiment for a trigger sprayer 5 according to the present invention. FIGS. 1 and 2 illustrate the trigger sprayer 5 having a sprayer head 10 with a first bottle 220 and a second bottle 240 detachably connected thereto. The first and second bottles 220 and 240 are releasable by operation of respective control tabs 72 and 76. The trigger sprayer 5 includes a trigger 20 which may be manually squeezed by the user to expel fluids out the nozzle cap 60. The user may operably rotate the dial wheel 40 to control relative mixture of fluids from the first and second bottles 220 and 240 by control mechanisms described below. The dial wheel 40 may be continuously variable, have incremental positions such as the six numbered positions (representing selected concentrations 0-5) which may have "click stop" ratcheting mechanism, or some other operable feature.

As shown in FIG. 2, the outer shell of the sprayer head 10 is constructed in two pieces or housing portions which attach to one another by a plurality of posts 12 spaced about the head 10. The sprayer head 10 has a trigger mechanism 20 which includes a cylindrical mounting collar 24 to permit pivoting or rotation about a pivot rod 15 which is comparable to one of the pivot posts 12 spaced about the sprayer head 10. The trigger 20 is comprised of an extending handle portion 22 which accepts the fingers of the operator allowing him to squeeze the device to pivot the trigger 20 about the pivot rod 15 thereby engaging the fluid pumping mechanism. The trigger 20 has a lever arm portion 26 extending with a hooked end portion 28 which engages a trigger post 149 on either side of the piston 140.

A biasing means illustrated as a coiled spring 30 is positioned externally to the piston and cylinder combination. The spring 30 is located between extending portion 27 of the trigger 20 and a seat 32 attached to sprayer head housing 10. The spring 30 biases the trigger 20 in toward an outward position (i.e. in a clockwise position as viewed in FIG. 2) thereby outwardly urging the trigger arm 22 and consequently urging the piston 140 in a direction to expand the volume within the cylinder 160 for drawing fluid into it.

When the piston 140 moves to draw a vacuum within the cylinder 160, fluid is drawn up from both the first bottle 220 and the second bottle 240. Fluid from the first bottle 220 passes through a first suction tube 235, through a metering means 100, through first tubing 96 and to the cylinder 160. Similarly, fluid from the second bottle 240 is drawn through a second suction tube 255, through connectors 54 & 56, into a second tubing 98, past a shut-off gate 120, and to the cylinder 160. Fluid within the cylinder 160 is then, upon squeezing of the trigger 20 and operation of the piston 140, forced out through the nozzle cap 60.

The fluid pumping mechanism is preferably a piston and cylinder combination comprised of a cylinder housing 160 having a piston 140 slidably actuatable therein. However, other suitable pumping mechanisms may be employed in certain embodiments. Such alternate pumping mechanisms may include for example a collapsible or squeezable bladder design, a diaphragm design or other suitable designs.

The first and second tubings 96 and 98 are preferably made from a flexible material so that as the piston 140 reciprocates, the tubings 96 and 98 flex back and forth with the piston movement.

The device is equipped with an externally operable ratio adjustment means comprising a metering means 100 which is controlled by rotation of a dial wheel 40. The dial wheel 40 is rotationally mounted on a pivot post 45. The metering means 100 is a fluid proportioning device which operates by an axial translation which produces variation in flow restriction of fluid therethrough. Rotation of the dial wheel 40 through connector piece 49 causes the axial translation of the top portion of the metering means 100. The metering means 100 is described in detail below. Alternately, the metering means 100 may be preset without any external varying means to deliver a predetermined fluid concentration.

As viewed in FIGS. 2, 3, 3*a*, and 3*b*, the first and second bottles 220 and 240 have identical shells configurations, the shells being generally round or cylindrical on three sides thereof and having flat portions 220*a* and 240*a* on the fourth sides thereof. The flat sides 220*a* and 240*a* each have a longitudinal groove 230 and 250 and a longitudinal protrusion 228 and 248 extending from the top shoulder to the bottom thereof. As can be viewed in FIGS. 3, 3*a*, and 3*b*, the first bottle 220 and the second bottle 240 are placed with their respective flat portions in an engaging relationship, the protrusion or tongue 228 of the first bottle 220 mates with and nests within the groove 250 of the second bottle 240 and the tongue 248 of the second bottle 240 mates with and nests within the groove 230 of the first bottle 220. This nesting arrangement results in a substantially mating relationship which provides a firmness and stability for the first and second bottles 220 and 240 relative to one another. Additionally, because the shells of the first and second bottles 220 and 240 are identical, the bottles are interchangeable and only one bottle design need be tooled and manufactured providing economic advantage.

Figure 3:
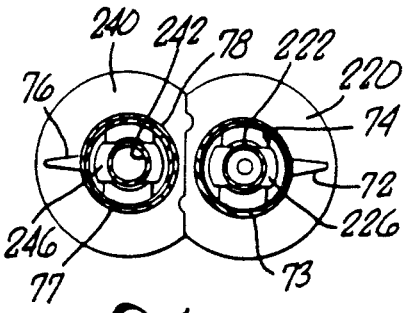
FIG. 3 is a cross sectional view of the spray bottle of FIG. 1 taken along the line 3—3.
Figures 3A, 3B:
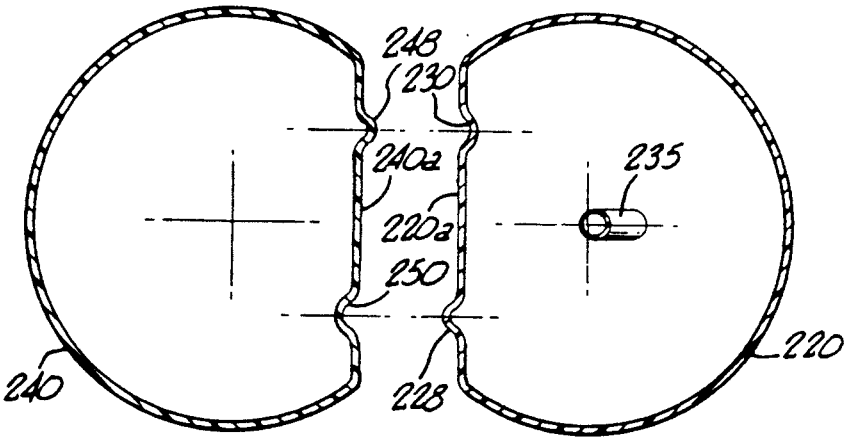
FIG. 3*a* is a cross sectional view of the bottle combination of FIG. 2 taken along the line 3*a*—3*a;*
FIG. 3*b* is a cross sectional view of the spray bottle combination of FIG. 2 taken along the line 3*b*—3*b;*
Figure 4A:
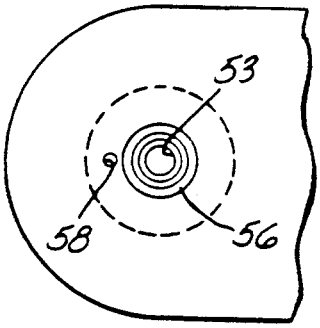
FIG. 4*a* is a cross sectional view of the device of FIG. 4 along the line 4*a*—4*a;*
Figure 5A:
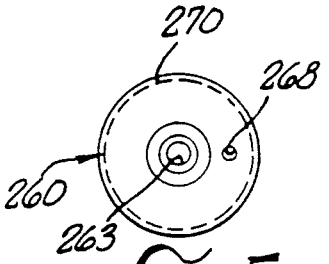
FIG. 5*a* is a cross sectional view of the device of FIG. 5 taken along the line 5*a*—5*a;*
Figure 4:
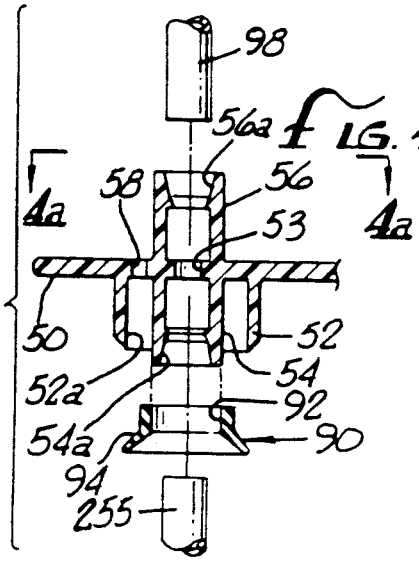
FIG. 4 is an enlarged exploded view of the bottle connection device of FIG. 2.
Figure 5:
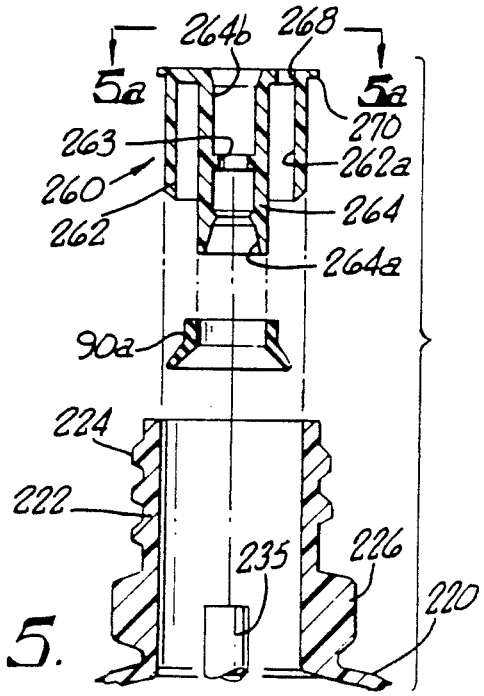
FIG. 5 is an exploded cross sectional view of the bottle neck of FIG. 2.

The tongues 228, 248 and grooves 230, 250 may be continuous as shown in FIGS. 3*a* and 3*b*, a continuous groove is the preferred construction because when the groove extends all the way from the bottle shoulder to the bottom, a sliding motion of the second bottle next to a first bottle during installation is facilitated as may be seen in FIG. 2. Alternately the tongue and grooves may comprise a series of mating elements consisting of protrusions and depressions. In the preferred arrangement, the mating elements comprise two, or some even number, of vertically or longitudinally arranged columns of protrusions and corresponding depressions such that a second bottle of identical configuration may mate with the first bottle in a side-by-side relationship.

In order to properly align, the longitudinal mating elements are spaced an equal distance from a centerline. Preferably, wherever there is a protrusion on one longitudinal mating element, there is a corresponding depression at the same longitudinal position in the other longitudinal mating element. Additional depressions will not inhibit the mating operation.

As viewed in FIGS. 2–5, each bottle 220 and 240 has a bottle collar 226, 246 which may be inserted into a respective rectangular opening 74, 77 within a respective bottle retainer collar 73, 78. The retainer collars 73, 78 are rotatable through a 90° arc by operation of tabs 72, 76. To illustrate the connection operation and referring to FIGS. 2 and 3, once the neck 222 of the first bottle 220 is inserted through the rectangular opening 74 of the retainer collar 73, the tab 72 is then rotated to position the rectangular opening 74 perpendicular to the bottle collar 226, thereby securing the bottle 220 to the sprayer head 10. As viewed in FIG. 3, the bottle collars 226, 246 are also somewhat rectangular (when observed in the plan view of FIG. 3) such that when the bottle collars are aligned, as for example in FIG. 2, the bottle collar 246 of the second bottle 240 may be slid through the bottle retainer collar 78 which has been rotated 90° such that the rectangular opening 77 aligns with the bottle collar 246, and the bottle collar 246 may be inserted through the rectangular opening 77. Once in place, the tab 76 may be actuated, rotating the bottle retainer collar 78 by 90°, as in FIG. 3, which secures the second bottle 240 in place.

In order to operationally describe the connecting apparatus, an example of a preferred application will now be described. The first bottle 220 may be filled with a fluid, such as a concentrated household cleaning fluid, and the second bottle 240 is then filled with a diluting fluid, typically water. The sprayer device then meters out a mixture of the cleaning fluid diluted with water, the household user refilling the second bottle 240 with water as needed.

The sprayer head 10 may be operably connected by separate connectors to the first and second bottles 220, 240 as shown, but may also be merely in fluid communication with two reservoirs or fluid chambers. By way of example, the bottles 220, 240 may be constructed and arranged to reside within a single shell with a dividing wall therebetween to form the two chambers. Alternately, the fluid tubings may merely be positioned in an open reservoir such as a bucket. In an application such as for a handheld sprayer, the bottles or vessels may alternately be arranged in a concentric relationship or in any suitable geometry to suit the particular application. For example, in an application where a fluid is highly concentrated and is to be heavily diluted with water, it may be desirable to nest a small concentrate bottle within a much larger bottle which is to contain the water.

The fluid connection for the second bottle 240 is illustrated in FIGS. 2–4 and 4*a*. The second suction tube 255 is inserted into a lower nipple 54 in the bottom of a tube retainer piece 50, the tube retainer piece 50 fitting in the bottom of the sprayer head 10. Fluid may pass through the second suction tube 255 through the lower nipple 54, through a passage 53 within the tube retainer piece 50, and then out through an upper nipple 56 into which the second tubing 98 is inserted. The tube retainer piece 50 has a collar section 52 concentric with the lower nipple 54 forming an annular passage 52*a* therebetween. The bottle neck 242 may be inserted over and around the concentric collar 52, the collar 52 may have a slight inward taper to allow for a tight sealing fit against the inside surface of the bottle neck 242.

Operationally in a preferred embodiment, the second bottle 240, after being filled with water, may be inserted around the second suction tube 255 into the bottle retainer collar 78, with the bottle neck 242 being firmly pressed around the concentric collar 52. Since the connection between the bottle neck 242 and the concentric collar 52 is airtight or at least substantially leak-proof, air is generally unable to enter the second bottle 240 to replace the volume of fluid which is pumped out through the second suction tube 255. To prevent creation of such vacuum, a venting means is provided to allow for air passage into the second bottle 240.

The preferred venting means includes an air passage through a vent hole 58 in the tube retainer piece 50. To prevent liquid from undesirably leaking out through the vent hole 58, the venting means comprises a retainer seal 90 positioned within the annulus 52*a* between the concentric collar 52 and the lower nipple 54. The retainer seal 90 is of generally a tubular shape with a first cylindrical portion which fits tightly against the outer surface of the lower nipple 54 and a diagonally outwardly extending or fanning portion 94 extending outward from the cylindrical portion 92 toward the inner surface of the concentric collar 52. The outwardly extending portion 94 fills and seals off the annular space 52*a*, pressing against the inner surface of the concentric collar 52. Due to its angular orientation, the retainer seal 90 acts as a one-way valve permitting air passing through vent hole 58 to inwardly flex the outwardly extending portion 94 of the retainer seal 90 and to enter the bottle 240 while preventing fluid from the bottle 240 to pass by the retainer seal 90 and leak out the vent hole 58.

The first bottle 220 has a similar venting means configuration comprised of a plug 260 having an inner nipple 264 and an outer concentric portion 262, the plug being inserted into the neck 222 of the first bottle 220 in a liquid-tight arrangement. The first suction tube 235 is inserted into the inner nipple 264. The upper portion of 264*b* of the plug nipple 264 is inserted around the nipple 80 of the tube retainer piece 50. The nipple 80 is tapered to allow for a tight sealing fit against the inside surface of the plug nipple 264. An annular passage is provided between the plug nipple 264 and the concentric portion 262 which provides a venting passage for allowing air to enter the bottle 220 to replace fluid being pumped out through the first suction tube 235. A venting means comprised of a retainer seal 90*a* is provided filling the annular passage 262*a* so that air passing through vent hole 268 may pass the retainer seal 90*a* and enter the bottle 220, but fluid is prevented from passing the retainer seal 90*a* in reaching the vent hole 268. The plug 260 has an upper lip or shoulder 270 so that when it is inserted into the bottle neck 222, it is prevented from being pushed down past the upper rim of the bottle neck 222.

The bottle neck 222 includes male threads 224 even though the threads are not used in the operation of the spray bottle. And as previously described, the first bottle 220 may be filled with a concentrated liquid which will be diluted by the device. A bottle of concentrate may be packaged individually with a screw cap secured over the bottle neck 222. The user need only remove the cap (not shown) and install the bottle 220 as previously described, since the plug 260, the retainer seal 90*a* and the first suction tube 235 may already be assembled within the first bottle 220. In addition, it may be desirable to switch to another bottle of concentrate, and the removed bottle may be conveniently recapped for storage.

Figure 6:
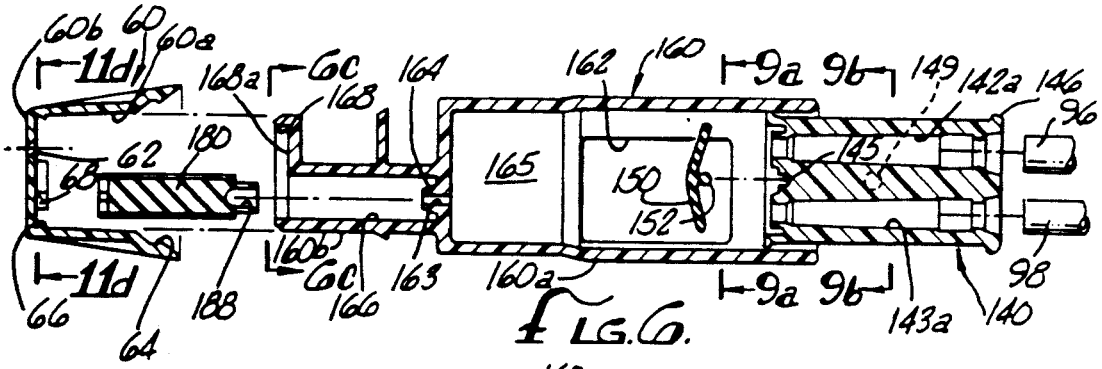
FIG. 6 is an exploded cross sectional view of the pumping device of sprayer combination of FIG. 2.

There are several types of pumping means which have been employed in fluid dispensing devices. The preferred pumping means is the piston and cylinder combination and nozzle disclosed herein as illustrated in FIGS. 6–11. FIG. 6 illustrates a partially exploded view of the pumping elements comprised primarily of a cylinder housing 160, a piston 140, a nozzle cap 60, and a tip seal 180. The cylinder housing 160 has a rear portion 160*a* having a rectangular window 162 on either side of. The rectangular window 162 allows for access of the trigger arm 26 to reach the trigger post 149 on the piston 140.

In the front portion of the cylinder housing 160*a* is the fluid compression chamber 165 where fluid from the first and second bottles 220 and 240 is mixed for ejection to the nozzle 60. A port 163 is located in the downstream end of the cylinder chamber 165 providing fluid communication from the cylinder chamber 165 to the nozzle passage 166. The port 163 has a protrusion or nipple portion 164 extending into the nozzle passage 166.

On the downstream end of the nozzle passage 166 is a shoulder or lip 168 which is positioned to provide a spacing between the front face 60*b* of the nozzle cap 60 and the front face portion 68*a* at the end of nozzle passage 166. The nozzle cap 60 has a snap connection 64 which, when the two halves of the sprayer head 10 are assembled, snaps over both halves as viewed in FIG. 2. The nozzle cap 60 has a sealing surface 62 which presses against the lip portion 168 in a sealing arrangement. The tip seal 180 is a elongated flexible rubber piece positioned within a nozzle passage 166 described in more detail below. The piston 140 has a first passage 142*a* in fluid communication with the first tubing 96 and a second passage 143*a* in fluid communication with the second tubing 98. When positioned in the cylinder portion 160, the piston 140 has a front sealing rim 144 sealingly engaging the inner surface of the fluid chamber 165 and a rear rim 146 engaging the inner surface of the rear portion 160*a* of the cylindrical portion 160. The rear portion 160*a* of the cylindrical portion 160 may be provided with grooves which correspond to protrusions in the lip portion 146 to ensure that the piston remains in rotational alignment within the cylinder 160. Alternately an O-ring, located in a suitable channel, may be employed in place of front sealing rim 144 to provide a sealing mechanism between the moving surfaces.

The piston 140 has a disk-shaped diaphragm 150 installed on its downstream end providing a one-way valve relationship from the passage exits 142*b* and 143*b*. The diaphragm 150 operates as a flapper or butterfly type one-way valve. It has a protrusion portion 152 which snap fits into a groove 145 in the piston 140. As shown in FIG. 6, in its resting state, the diaphragm 150 has a camber of approximately 15° so that when installed upon the piston, the outward wing portions are biased against the exit portions 142*b* and 143*b* of the piston 140 establishing a positive sealing pressure against the valve seats 142*b* and 143*b*. When the unit is at rest, this positive sealing pressure inhibits fluid leaking from the chamber 165 back into the bottles 220 and 240. This positive sealing pressure also inhibits siphoning of fluids between the bottles 220 and 240 through the chamber 165.

The operations of the retainer seals 90 and 90*a* also serve to inhibit siphoning of fluids between the bottles 220 and 240. For example, the retainer seal 90 is placed in the annular space 52*a* in a flexing condition, exerting positive pressure against the side walls to seal of the passage. In order for a siphoning effect (out of bottle 240) to occur, the siphoning force would have to overcome the sealing force of the flexed retainer, so the siphoning effect is inhibited. Similarly, for fluid to be siphoned into the second bottle 240 air would have to be released to make room for any incoming fluid. The retainer seal 90 prevents fluid or air from escaping past the retainer seal 90 thereby inhibiting fluid from even entering the bottle 240.

Figure 6A:
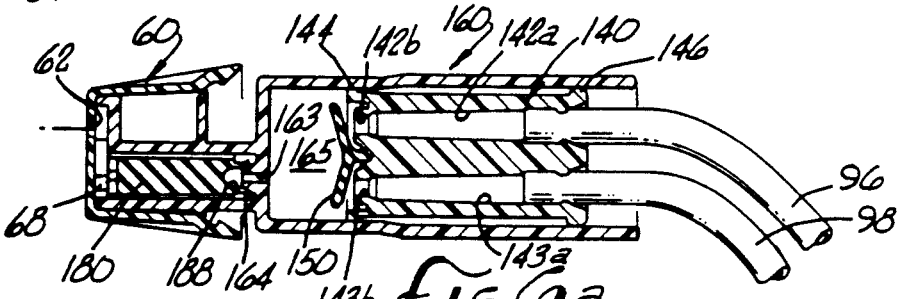
FIGS. 6*a* and 6*b* illustrate the operation of the piston and cylinder and nozzle combination of FIG. 6, FIG. 6*a* illustrating the piston drawing liquid into the cylinder chamber and FIG. 6*b* illustrating the piston expelling liquid out of the cylinder chamber.
Figure 6B:
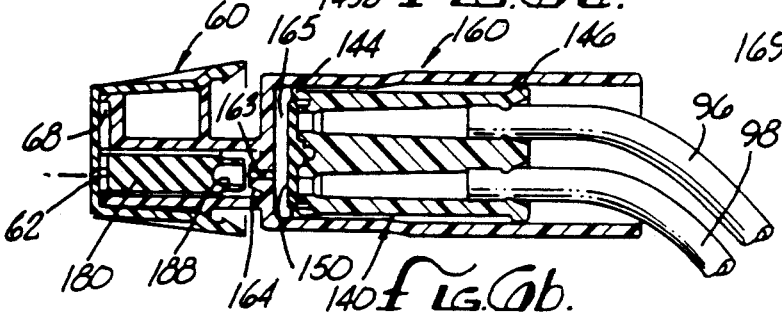

In operation, when the piston 140 is actuated to the right as viewed in FIG. 6*a* (by operation of the spring 30 as viewed in FIG. 2), fluid is drawn through the passages 142*a* and 143*a*, the diaphragm 150 flexing (as shown in the FIG. 6*a*) to permit fluid to enter the fluid chamber 165. When the trigger 20 is squeezed, the piston 140 is moved to the left as viewed in FIG. 6*b* and the fluid within the chamber 165 is compressed, the diaphragm 150 pressing against and sealing off the cylinder ports 142*b* and 143*b* forcing fluid out through the port 163 into the nozzle passage 166.

Since the biasing means is external to the cylinder chamber 165, the piston 140 may be pressed all the way to the wall of the cylinder 160 which substantially allows the fluid chamber 165 to be completely emptied.

The divided passage piston 140 permits the fluids from the first and second bottles 220 and 240 remain separated and at their original concentrations all the way to mixing chamber 165.

The tip seal 180 is a highly flexible and preferably elastic elongated member having a plurality of longitudinal ribs 182 spaced around its outer perimeter. At its downstream edge, the tip seal 180 has an outwardly lip or edge 84 forming a front facing recess 184. The lip 84 has a pair of parallel angular gaps 186 which creates a swirling motion when fluid enters into the recess 184.

The tip seal 180 is preferably of one-piece construction. In operation, fluid is allowed to pass in an annular space between the outer circumference of the tip seal 180 along the ribs 182 and the inner wall of the nozzle passage 166. The tip seal 180 may be sized to substantially fill the nozzle passage 166 so that at the end of the compression stroke of the piston 140, nearly all the fluid mixture may be dispensed out the nozzle opening 62.

The tip seal 180 also includes a recess or cavity 188 which corresponds to the protrusion 164 of the port 163. The tip seal 180 is axially translatable within the nozzle passage 166 between positions illustrated in FIGS. 6*a* and 6*b*. During the rearward stroke of the piston 140 filling the fluid chamber 165, the tip seal 180 is drawn rearward as viewed in FIG. 6*a* with the recess 188 engaging the protrusion 164 effectively sealing off the port 163. During the compression stroke as in FIG. 6*b*, fluid exiting the ports 163 presses the tip seal 180 downstream to permit exit of fluid through the port 163 and into the nozzle chamber 166. The tip seal 180 functions as the second one-way valve of the positive displacement from piston and cylinder combination.

In a preferred embodiment the tip seal 180 is constructed from a relatively soft and resilient material which is stretched over the protrusion 164 (the protrusion 164 extending further into the cavity 188 than shown in the figures).

In operation, the force of fluid exiting the port 163 causes the tip seal cavity 188 to expand and allow the fluid to enter the passage 166. When the fluid flow stops, the tip seal 180 resiliently returns against the protrusion 164 exerting a positive sealing force thereagainst. The flexure of the tip seal 180 itself would inhibit leakage of fluid out the nozzle even when the sprayer is in a resting state.

This functional combination of (1) the cylinder 140 completely emptying the fluid chamber 165, (2) minimizing the volume of leftover fluid downstream of the fluid chamber, and (3) keeping the fluids from the first and second bottles 220 and 240 remain separated and at their original concentrations all the way to mixing chamber 165 all contribute to insuring that a minimum amount of mixed fluid (that is, fluid from a particular actuation) remains in the system for a subsequent actuation. Therefore, when a different fluid mixture setting is selected, a minimum amount of fluid mixture from the previous setting, i.e. substantially only one volume of the fluid chamber 165, is ejected which has the previous setting for concentration mixture.

The nozzle cap 60 includes an exit opening 62 which is tapered having a decreasing diameter. The nozzle opening 62 is eccentrically positioned on the front face of the nozzle cap 60, the nozzle cap 60 being rotatable between positions to select a spray pattern. The nozzle may be positioned to select a wide spray, a fine stream, or a shut-off position.

Figure 6C:
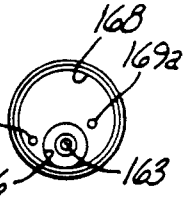
FIG. 6*c* is a side elevation view of the cylinder of FIG. 6 taken along the line 6*c*—6*c;*
Figure 8:
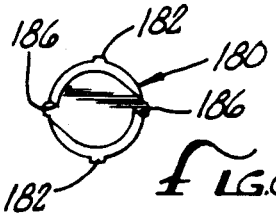
FIG. 8 is a front elevation view of FIG. 7 taken along the line 8—8.
Figure 7:
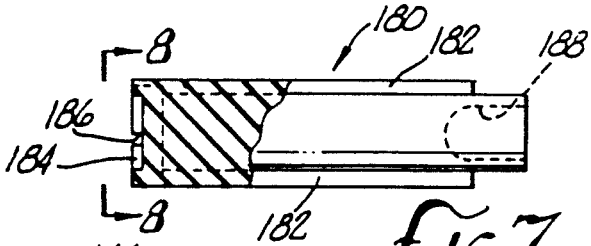
FIG. 7 is a side elevation view in partial cross section of the tip seal of FIG. 6.
Figure 9B:
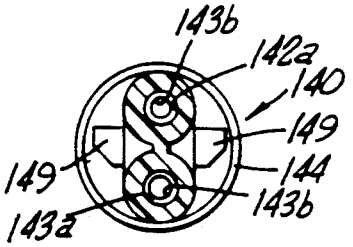
FIG. 9*b* is a cross sectional view of the device of FIG. 6 taken along the line 9*b*—9*b;*
Figure 10:
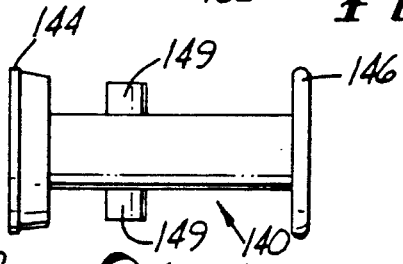
FIG. 10 is a top plan view of the cylinder of FIG. 6.
Figure 9A:
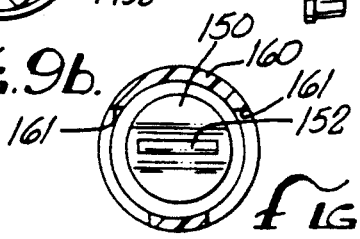
FIG. 9*a* is a cross sectional view of the device of FIG. 6 taken along the line 9*a*—9*a;*
Figure 11A:
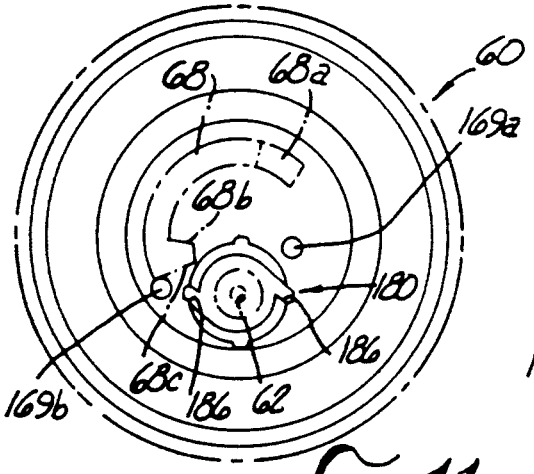
FIGS. 11*a*, 11*b* and 11*c* diagrammatically illustrate the operation of the exit nozzle of FIG. 6, FIG. 11*a* illustrating the nozzle in a wide spray mode, FIG. 11*b* illustrating the nozzle in a fine stream spray mode, and FIG. 11*c* illustrating the nozzle in a shut-off mode.

As viewed in FIG. 6*c*, the face 168 of the cylinder portion 160 has a pair of stops 169*a* and 169*b* which function to assist in the positioning of the rotation nozzle cap 60. In FIG. 11*a* the nozzle cap 60 is rotated in a counter-clockwise direction with the rotation halted when the stop surface 68*c* engages the stop 169*b* thereby positioning the nozzle aperture 62 in line with the tip seal 180. Fluid swirling through the apertures 186, 186 exits the nozzle aperture 62 in a wide spray pattern.

Figure 11B:
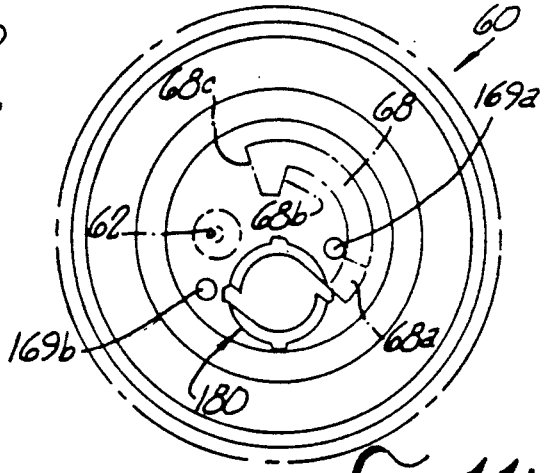

In FIG. 11*b*, the nozzle cap 60 is rotated to a position with the stop surface 68*c*/68*b* between stops 169*a* and 169*b*. In this position, the nozzle aperture 62 is offset from tip seal 180 and fluid exiting nozzle passage 166 is not swirled and therefore exits the nozzle aperture 62 in a fine stream spray pattern.

Figure 11C:
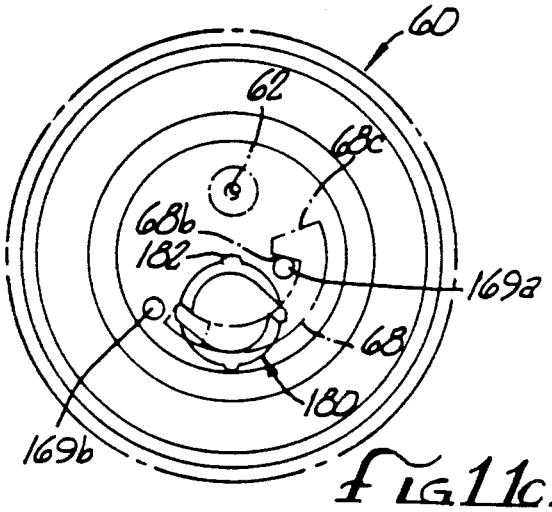
Figure 11D:
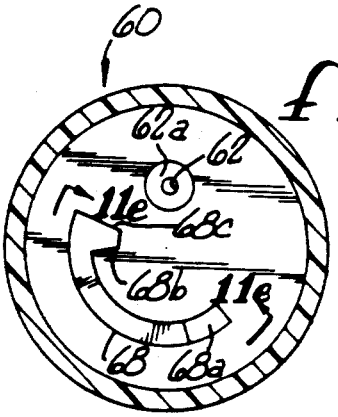
FIG. 11*d* is a cross sectional view of the nozzle cap of FIG. 6 taken along the line 11*d*—11*d;*
Figure 11E:
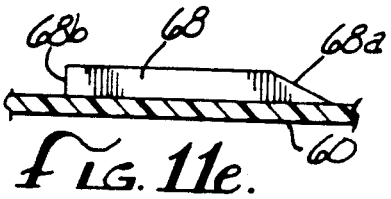
FIG. 11*e* is a cross sectional view of the nozzle tip of FIG. 11*d* taken along the line 11*e*—11*e;*

In FIG. 11*c*, the nozzle cap 60 has been rotated in a clockwise direction with the rotation halted when the stopping surface 68*b* engages against the stop 169*a*. In this position, the location of the nozzle aperture 62 is irrelevant. Referring also to FIGS. 11*d* and 11*e*, the curved stop surface 68 has a ramp 68*a* which engages the tip seal 180 when the nozzle cap 60 is rotated into position as illustrated in FIG. 11*c*. When placed in such position, as viewed in FIG. 6*a*, the curved stop surface 68 presses against the tip seal 180 forcing it against the port protrusion 164 with the tip seal recess 188 sealing off the port 163 effectively shutting off the exit of fluid therethrough.

The flow control device will now be described with respect to FIGS. 12–16. The heart of the flow control device which allows for varying the ratio of fluid mixture between the first bottle to 20 and the second bottle to 40 is the metering means 100. The metering means has an outer cylindrical housing piece 102 and an inner metering rod 110. Fluid from the first bottle 220 passing through the nipple 80 enters into a chamber 112 within the metering rod 110. The base 116 of the metering rod 110 seats within a cylindrical protrusion 82 in the tube retainer piece 50, the base 116 having a lower cylindrical leg portion 114 seating concentrically within the cylindrical portion 82 to provide firm support and additional sealing surface therebetween. Once fluid has passed into the inner chamber 112 of the metering rod 110, it may pass outward through ports 114 and into an annular space between top portion 110*b* of metering rod 110 and the lower portion 102*a* of the meter housing 102.

Figure 12A:
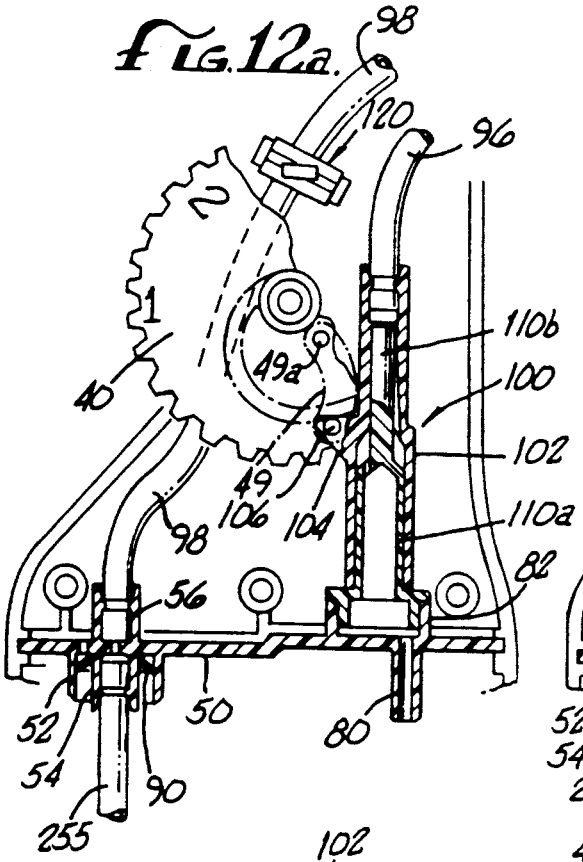
FIGS. 12*a* and 12*b* illustrate the operation of the metering device of the sprayer, FIG. 12*a* illustrating the metering device closing off the flow of fluid therethrough, FIG. 12*b* illustrating the metering device at maximum flow therethrough.
Figure 12B:
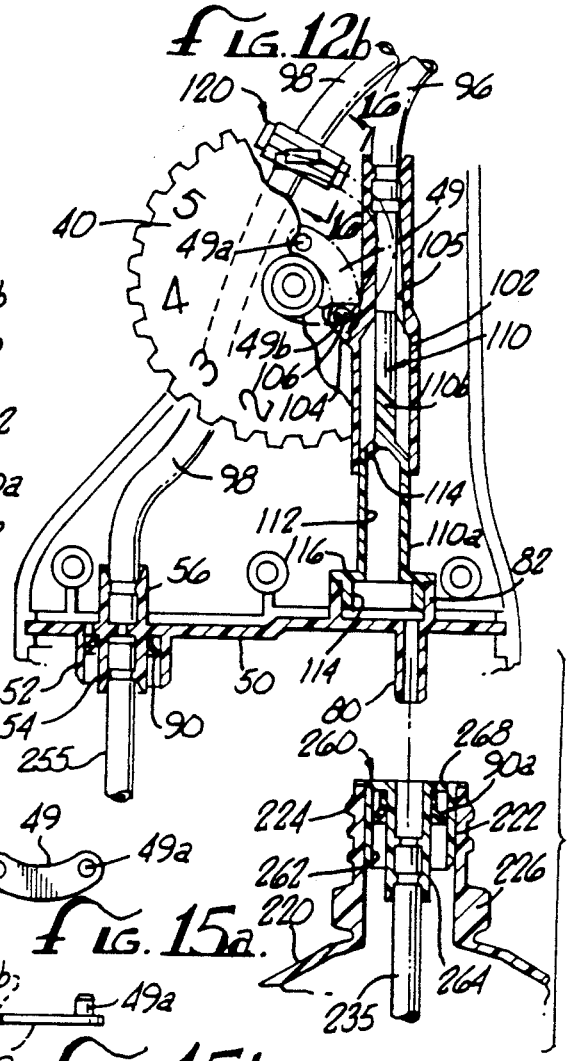
Figure 15A:
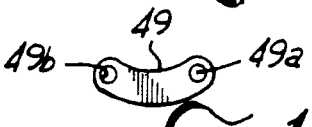
FIG. 15*a* is a plan view of the connector piece connecting the metering control wheel to the metering device of FIG. 12*a;*
Figure 15B:
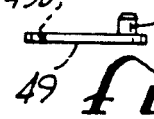
FIG. 15*b* is a side elevation view of the connector piece of FIG. 15*a;*
Figure 14:
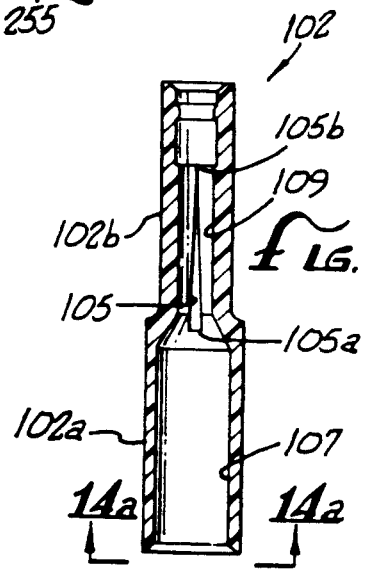
FIG. 14 is an enlarged view of the movable portion of the metering device of FIGS. 12*a* and 12*b;*
Figure 16:
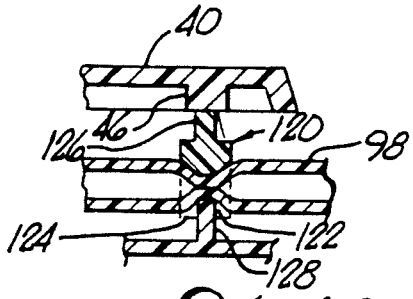
FIG. 16 is a cross sectional view of the cut-off gate of FIG. 12*b* taken along the line 16—16.
Figure 14A:
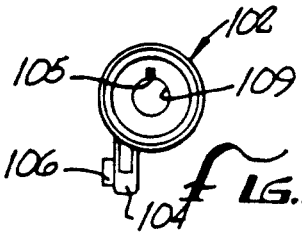
FIG. 14*a* is a bottom plan view of the metering device portion of FIG. 14 taken along the line 15—15.

By rotation of the dial wheel 40, the meter housing 102 may be axially translated from an off position or low flow position as viewed in FIG. 12*a* to a high flow position as viewed in FIG. 12*a*.

Fluid flows between the upper portion 110*b* of the metering rod 110 and the upper passage 109 of the meter housing 201 through an axial slot 105 cut along the inner surface of the upper portion 102*b* of the meter housing 102. Except within this passage 105, the upper portion 110*b* of the metering rod 110 snugly fits within the upper passage 109 of the meter housing 102 thereby finally regulating the flow of fluid through passage 105.

The depth and width of the passage 105 are gradually reduced from the upstream portion 105*a* to the downstream portion 105*b*. If desired, the metering rod 110 may have a position as in FIG. 12*a* which completely shuts off flow of fluid through the passage 105.

In order to prevent leakage of fluid, a sealing mechanism is provided between the metering rod 110 and the meter housing 102 comprised of a radial rim along an outer circumference of the metering rod 110 adjacent the ports 114, the rim being approximately 0.005 inches high by 0.020 inches wide. A second sealing rim 102*c* is also provided on the inner circumference of the meter housing lower portion 102*a* immediately adjacent the bottom thereof. In addition, the metering rod 110 and the meter housing 102 may be constructed from different density materials. In the preferred application, the metering rod 110 is constructed from high density polyethylene and the meter housing is constructed from low density polyethylene. This design and material selection enhance the sliding seal between the metering rod 110 and the meter housing 102.

The sealing function of the radial rim along an outer circumference of the metering rod 110 and the second sealing rim 102*c* may alternately be provided by O-rings positioned in channels at suitable locations.

As viewed in FIGS. 12*a*, 12*b*, 14*a*, 15*a*, and 15*b*, the meter housing 102 includes an extending arm 104 having a protrusion which mates into a hole 49*b* in the connector piece 49. A protrusion 49*a* on the other end of the connector piece 49 is inserted into a matching hole 45 in the dial wheel 40. The connector 99 is connected to the dial wheel 49 in an off-centered relationship to the center of the dial wheel 40 such that when the dial wheel 40 is rotated, the meter housing is axially translated as previously described.

Figure 13A:
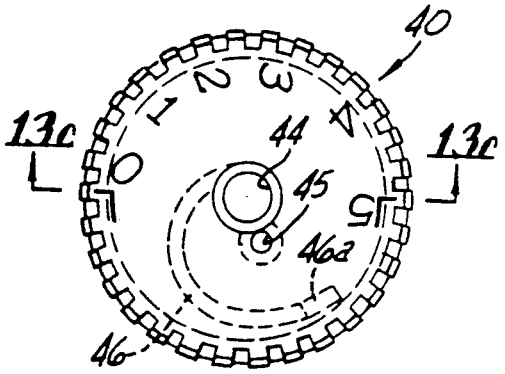
FIG. 13*a* is a top plan view of the metering dial of FIGS. 12*a* and 12*b;*
Figure 13B:
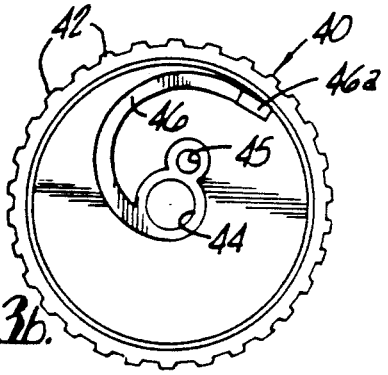
FIG. 13*b* is a rear plan view of the metering dial of FIG. 13*a;*
Figure 13C:
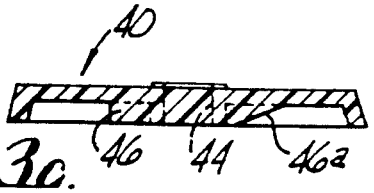
FIG. 13*c* is a cross sectional view of the control dial of FIG. 13*a* taken along the line 13*c*—13*c;*

Details of the dial wheel 40 are illustrated in FIGS. 13*a*, 13*b*, and 13*c*. Dial wheel 40 has a notch connection 44 secured into a post within the spray head 10 as previously described. A curved ramp 46 with an end ramping portion 46*a* is positioned along an inner face thereof. As viewed in FIG. 12*b*, when the meter housing is translated into the maximum flow condition, the ramp 46*a* engages the flow cut-off device 120 as viewed in FIG. 16. The flow cut-off device is a gate device which straddles the second tubing 98 when the ramp 46 engages the upper portion 126 of the cut-off mechanism 120, the sliding gate squeezes the second tubing 98 against a lower edge portion 128 restricting and then cutting off flow of fluid within the second tubing 98. Therefore, at maximum flow out of the first bottle 220, flow from the second bottle is cut-off so that the fluid dispensed is 100% from the first bottle 220.

There are many variations to the above-described preferred embodiments. It has been described that a flow metering or flow ratio varying device may be manually adjusted to select relative flow ratios anywhere between 100% fluid from the first bottle 220 to 100% from the second bottle 240. Of course, an alternate spray head may have ratio limits of any minimum or maximum amount. Alternately, a spray head may be provided without varying control but merely have a preset ratio position which, for example, would spray out a preset concentration of a diluted fluid.

Figure 14B:
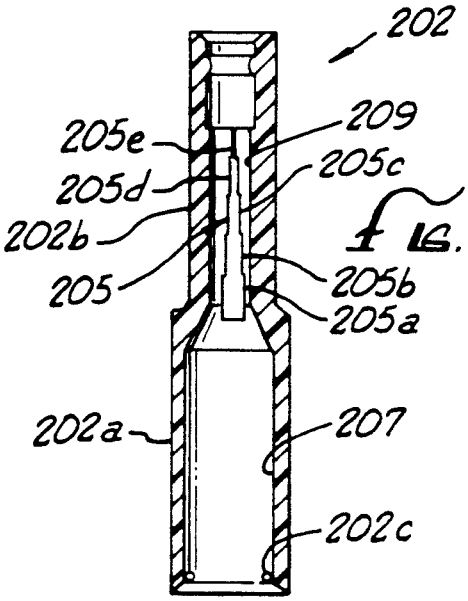
FIG. 14*b* is an alternate embodiment of the movable portion of the metering device of FIGS. 12*a* and 12*b;*

The adjustment of the metering device 100 allows for continuously variable adjustment of flow therethrough. Alternately, the device may be modified to provide for different flow adjustment characteristics. For example, in FIG. 14*b*, metering device housing 202 has an lower portion 202*a* and an upper portion 202*b*. The metering channel 205 which extends axially along an inner surface 209 of the upper portion 202*b* includes a step channel 205 having five steps or width portions 205*a*, 205*b*, 205*c*, 205*d*, 205*e*. This metering device housing 202 would provide five discrete flow ratios (as selected by the user or manufacturer) as the position of the meter housing 202 is adjusted relative to the metering rod 110. The metering housing 202 is provided with a sealing mechanism, consisting of an 0-ring 202*c* in the inner surface 207 of the lower portion 202*a*

The connection designs for the first and second bottles 220 and 240 as disclosed above were selected for a particular application, but both of the connection designs may be used at either bottle location. For example, a sprayer may be comprised of both bottles having removable and refillable bottle connections as possessed by the second bottle 240.

The materials of construction will be in part dependant upon the types of fluid being used in the bottles. For example, in the application where the first bottle 220 is filled with high concentration cleaning fluid and the second bottle is filled with water as a diluting fluid, certain materials may be preferred. The tubings, particularly the ones that come in contact with the concentrated cleaning fluid, may be constructed from ethyl-based urethane. The bottles 220 and 240 and the other components in fluid contact with the cleaning fluid may be made from ethyl based polyethylene. The seals, namely the tip seal 180, the diaphragm seal 150, and the retainer seals 90 and 90*a* may be constructed from compression molded silicon. Neoprene is also a desirable material of construction depending upon the application. It should be noted that the tip seal 180, which serves the function of a downstream check valve, requires a certain clearance to permit passage of fluid therearound. The tip seal 180 is preferably constructed from a material impervious to the working fluids as swelling of the seal may have detrimental impact on the performance of the valve.

Figure 18:
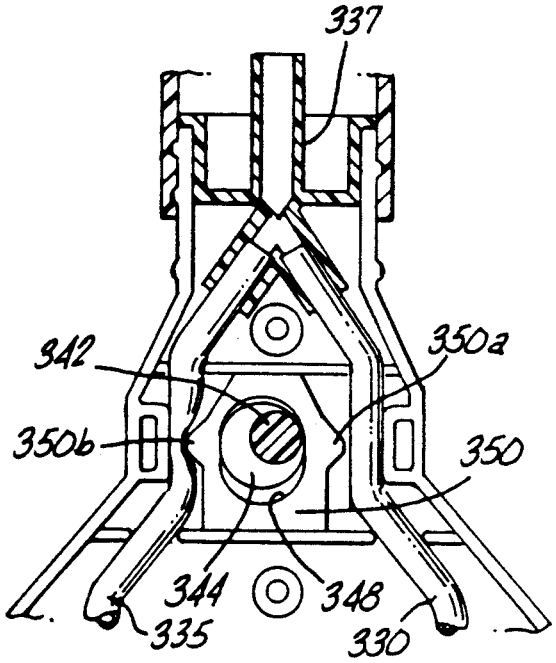
FIG. 18 is a diagrammatic view of the control device of FIG. 17.
Figure 17:
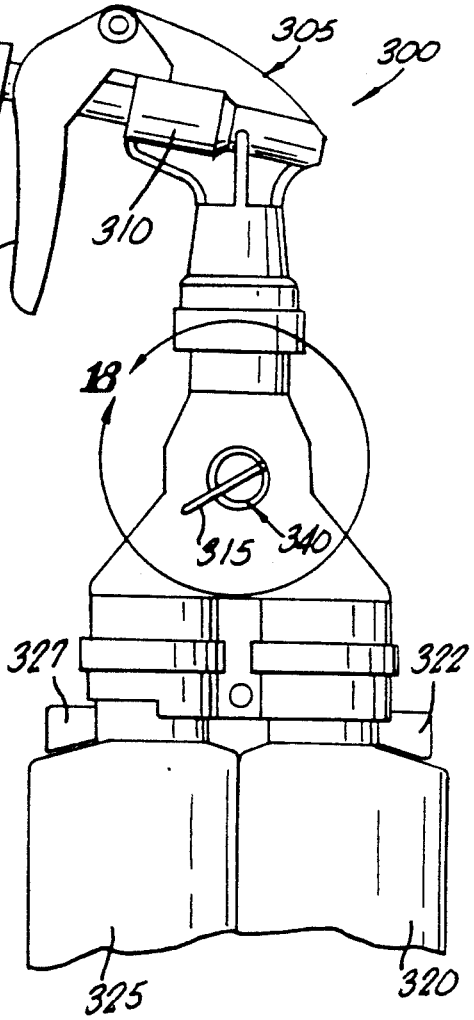
FIG. 17 is an alternate embodiment trigger sprayer device.

An alternate spray bottle 300 is illustrated in FIGS. 17 and 18. This sprayer 300 has a sprayer head 305 which is installed on first and second bottles 320 and 325 detachably connected by tabbing mechanisms 322 and 327 similar to those as previously described. The sprayer head 305 has a pumping mechanism 310, a trigger 307 and an exit nozzle 309.

Flow ratio control is accomplished by a rotating switch 340 having an actuator handle 315. The switch 340 may have incremental positions or be continuously variable. The handle 315 rotates about an inner shaft 342 to which a cam 344 is attached. The cam 344 rotates within a slot 348 in a sliding gate 350. The gate 350 has protrusions 350*a* and 350*b* on opposite ends thereof which, depending upon the position of the switch 315 (and thereby the position of the cam 344) slides to one side or the other depressing the first tubing 330 or the second tubing 335 selectively restricting flow through one or the other thereby controlling the fluid ratio. In this embodiment, the tubings 330 and 335 are connected through a "Y" connector 337 before entering the pump mechanism 310, but the pump mechanism could be identical to the dual passage piston combination previously described.

Figure 21:
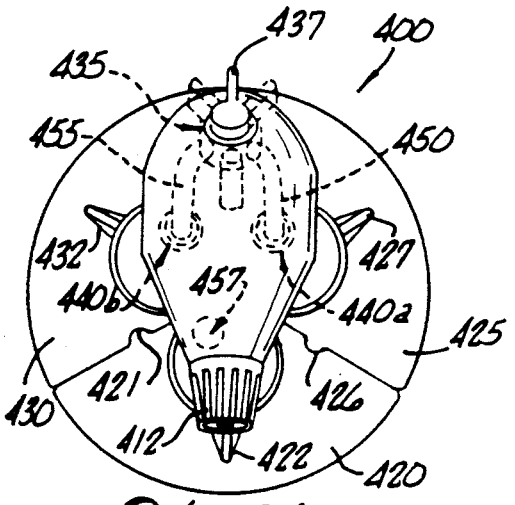
FIG. 21 is a top plan view of FIG. 20 taken along the line 21—21.
Figure 20:
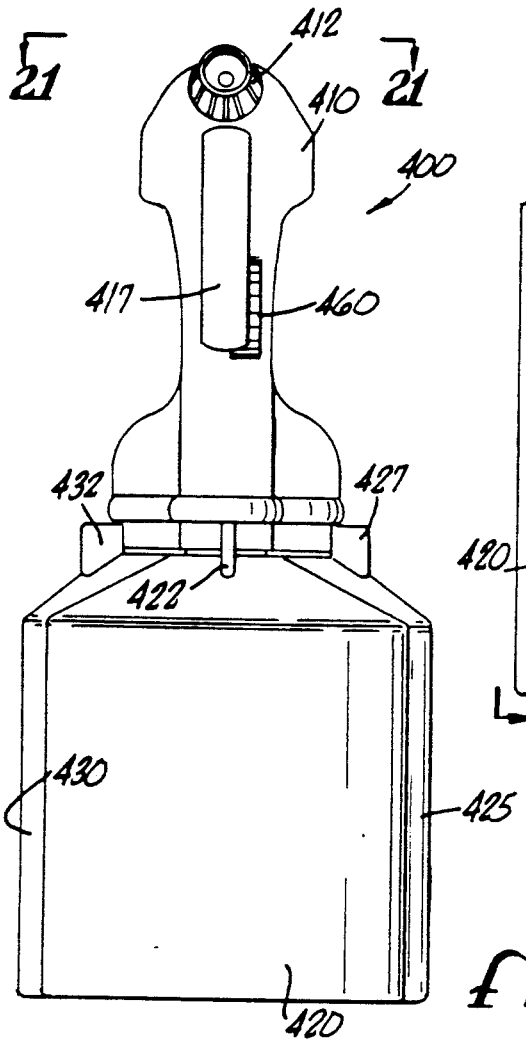
FIG. 20 is a front elevation view of the trigger spray device of FIG. 19 taken along the line 20—20.
Figure 19:
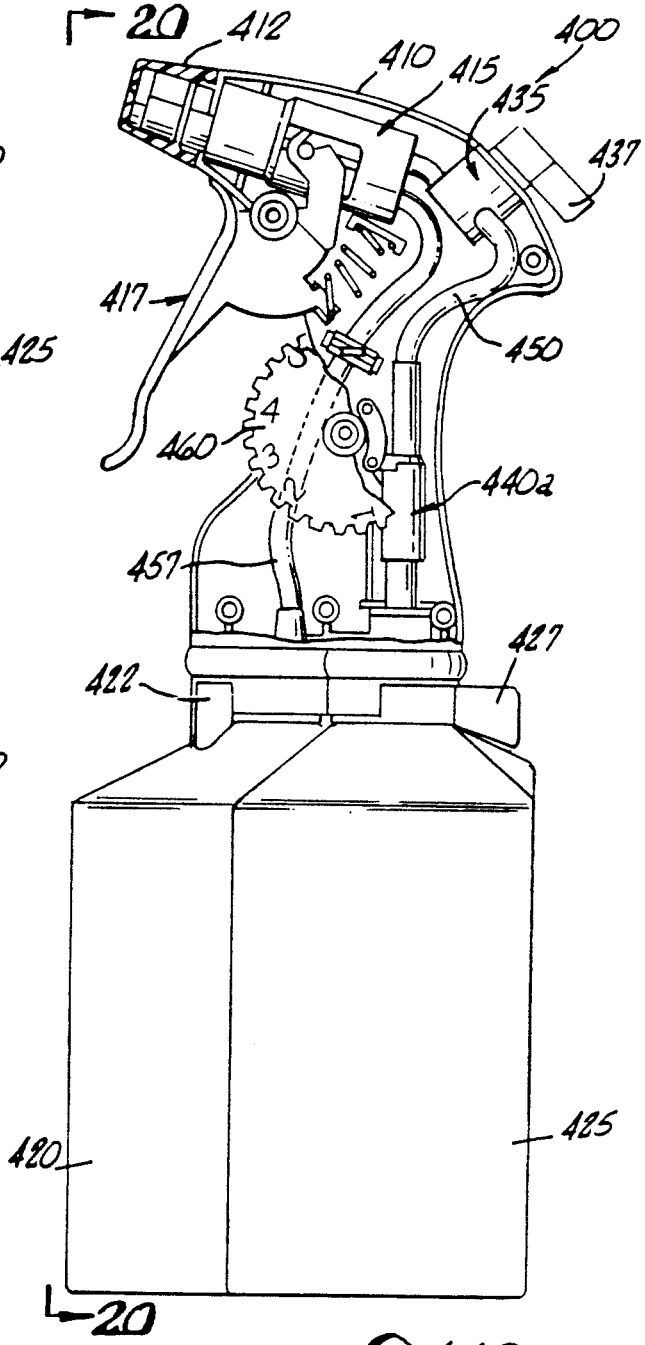
FIG. 19 is a side elevation view in partial cross section of an alternate trigger sprayer device having three fluid containers from which fluids can be drawn.

The preferred embodiment of the present invention is not limited to a two-bottle configuration, and FIGS. 19–21 illustrate a three-bottle combination. The three-bottle design sprayer 400 has a sprayer head 410 mounted upon three bottles, 420, 425 and 430. The bottles 420, 425, and 430 are generally pie-shaped with tongue and groove connections such as 421 and 426 of similar configuration to the two-bottle design previously described. Desirably, each of the bottles is interchangeable as in previous embodiments. The bottles are detachably secured to the head 410 by rotation of tabs 422, 427 and 432 using mechanisms also previously described.

One use for this tri-bottle configuration would be having a first fluid concentrate in the first bottle 425, and a second fluid concentrate in the third bottle 430. The second bottle 420 would then contain the dilution fluid such as water. Both the first bottle 425 and the third bottle 430, have respective metering devices 440*a* and 440*b* and respective tubings 450 and 455 leading up to a valving mechanism 435.

By manipulation of the dial wheel 460 (of course, there could be a dial for each metering device) both the metering devices 440*a* and 440*b* are actuated to provide the desired concentration ratio. The upper control device 435 has a handle switch 437 which may be actuated between any desired position, FIG. 21 arbitrarily illustrating three positions namely a first position having fluid completely from the first bottle 425, a second middle position allowing fluid from both the first bottle 425 and the third bottle 430, and a third position permitting fluids solely from the third bottle.

The metering switch 435 may be comprised of the cam construction as that previously described with respect to the embodiment of FIG. 18. Similarly, the pumping device 415 may include three passages therethrough so that the fluid mixing takes place in the pump chamber as far downstream as possible. Alternately, the exit port from metering device 435 may include a "Y" connection so that the pumping device has a two-passage piston as previously described in the embodiment of FIG. 1.

Figures 22, 23, 24:
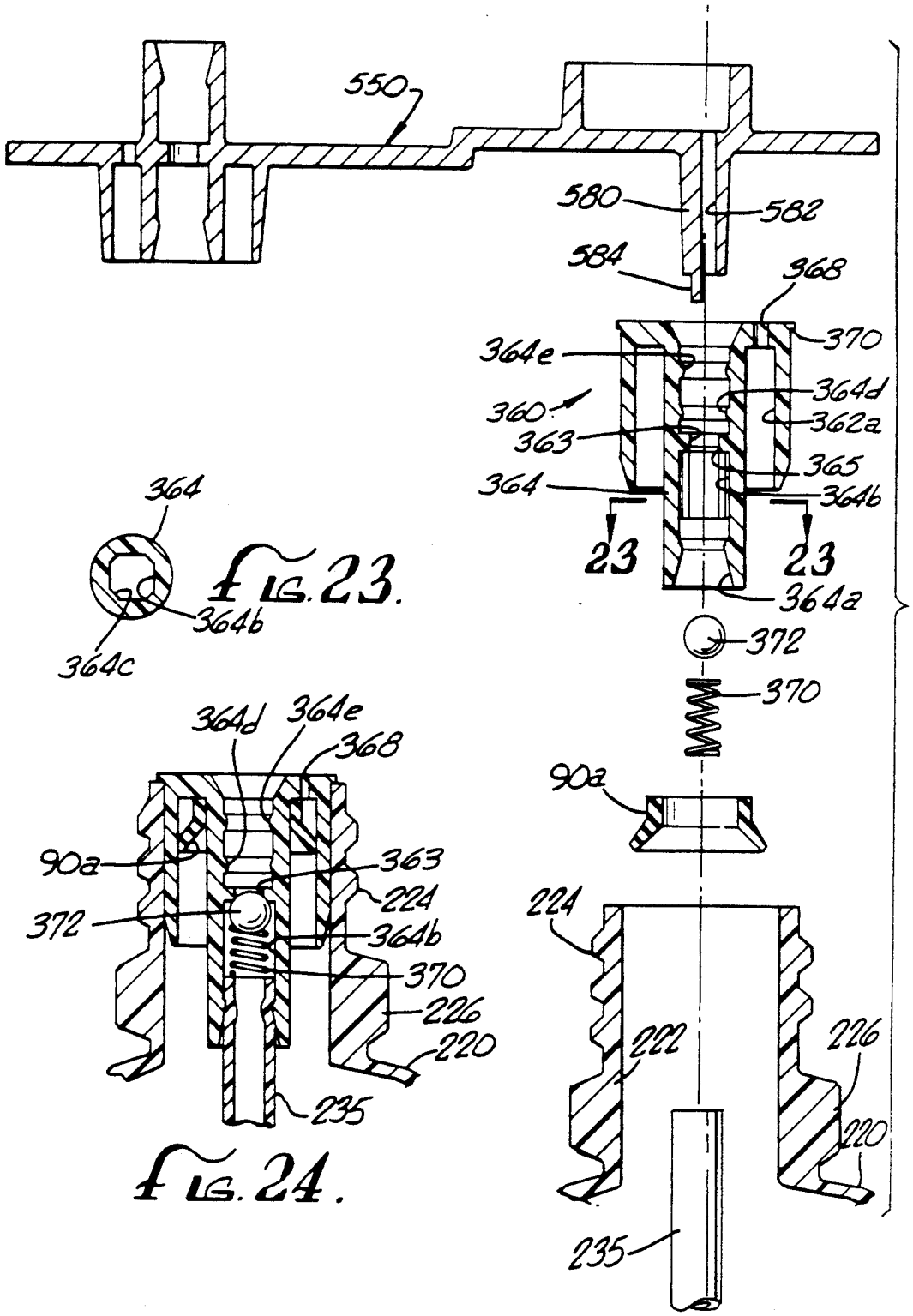
FIG. 22 is an exploded view in partial cross sectional of a preferred alternate bottle and connection design which includes a check valve.
FIG. 23 is a cross sectional view of FIG. 22 taken along line 23—23.
FIG. 24 is a cross sectional view of the preferred bottle connector design in the removed condition.
Figure 25:
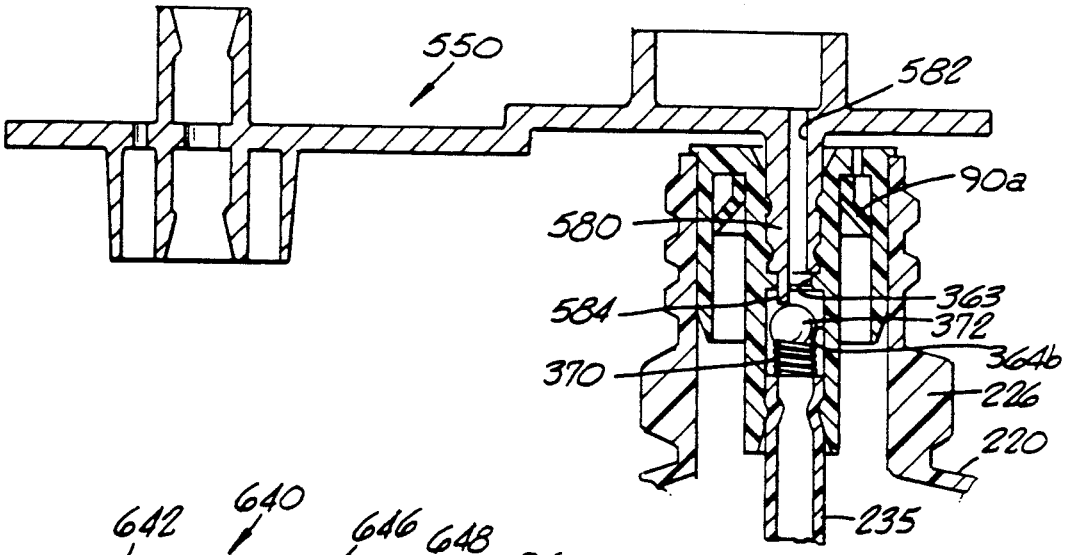
FIG. 25 is a cross sectional view of the preferred bottle design in the attached position.

FIGS. 23–25 illustrate an alternative embodiment for the connection mechanism between the bottle of 220 and the tube retainer piece 550. In this embodiment, the bottle 220 is equipped with a check valve comprised in this embodiment of a spring 370 and ball 372, disposed in the inner passage 364*b* of the retainer plug 360. The retainer plug 360 includes an inner passage 364*b* and an outer annular passage 362*a*. Each of the passages 364*b* and 362*a* are equipped with a check valve, namely the retainer seal 90*a* disposed in the outer annular passage 362*a* and the ball check 370/372 disposed in the inner passage 364*b*. As shown in FIG. 23, the ball 372 and spring 370 are disposed in a square portion of passage 364*b* insuring that there is flow passage around the ball 372.

The dip tube 235 snap fits into the bottom portion of 364*a* of the nipple portion 364. The dip tube 235 also serves to contain the spring 370 and ball 372 in position within the passage 364*b*. When installed, the ball 372 is urged by the spring 370 against a sealing surface 365 formed on the edge of a protrusion 363. FIG. 24 illustrates the bottle 220 in a detached condition with the ball 372 closing of the inner passage 364*b*. In this position, liquid from inside the bottle 220 cannot pass through the inner passage 364*b*. Similarly, the retainer seal 90*a* prevents liquid from exiting through outer passage 362*a* through the vent 368 in the end of the retainer plug 360.

The bottle 220 is then connected to the retainer piece 550 by inserting the nipple portion 580 into the inner passage 364*b* of the retainer plug 360. The nipple 580 may have slight taper to allow for a tight sealing fit within the inner passage 364*b*. The inner passage 364*b* includes a pair of protruding rings 364*d* and 364*e* which provide for additional sealing surfaces against the nipple 580. When assembled, fluid from the bottle 220 will have a flow path up the dip tube 235, through the inner passage 364*b*, and through the passage 582 in nipple 580.

The nipple 580 also includes a protruding element 584 at its end adjacent the bottle. As shown in FIG. 24, when the bottle 220 is inserted in place, the protruding element 584 contacts the ball 372 pushing the ball 372 away from the sealing surface 365, compressing spring 370 and opening the passage for liquid from dip tube 235 to pass into the nipple passage 582.

As shown in FIG. 25, when the bottle 220 is removed from the tube retainer piece 550, the ball 372 is urged back into contact with the sealing surface 365 thereby closing off the exit for fluid from the dip tube 235. The combination of the ball and spring 372/370 and the retainer seal 90*a* prevent leakage of liquid through the inner passage 364*b* and outer annular passage 362*a* respectively.

Figure 26:
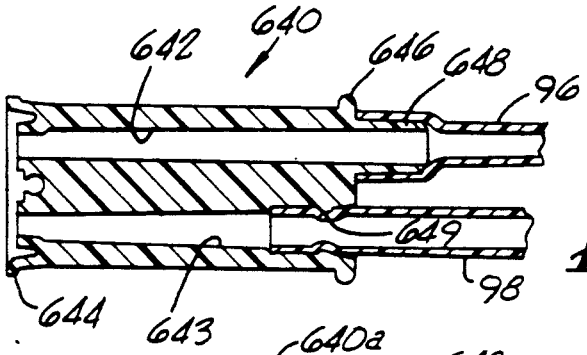
FIG. 26 is a cross sectional view of an alternate piston design having a single male tube connector design.
Figure 27:
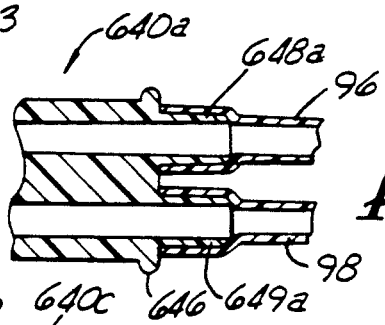
FIG. 27 is a cross sectional view of an alternate piston design having a dual male tube connector design.

FIGS. 26 and 27 illustrate alternate connection configurations for tubings 96, 98 to the piston 640. In FIG. 26, tubing 96 is attached externally over a male nipple portion 648, the tubing 96 stopping at the guide portion 646. Once installed, a fluid communication path is established between the tubing 96 into the first passage 642 in the piston 640. The second tubing 98 is inserted internally into the second piston passage 643, the passage 643 including in a internal protruding ring 649 to provide additional sealing force on the second tubing 98.

FIG. 27 illustrates both the first and second tubing 96,98 being connected to the piston 640*a* on nipple portions 648*a*, 649*a*, respectively, the tubing 696, 698 extending and stopping against guide portions 646.

Figure 28:
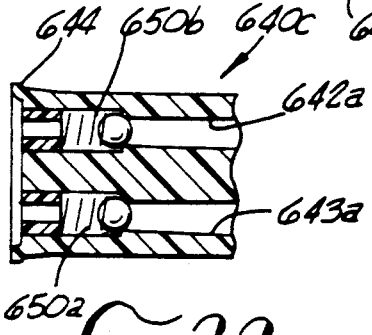
FIG. 28 is a cross sectional view of an alternate pump design having a piston with dual internal check valves.

FIG. 28 illustrates another alternate piston 640*c* having separate check valves 650*a*, 650*b* disposed in the ends of internal channels 642*a* and 643*a* within the piston 640*c*. In this configuration, the butterfly check valve 150 of FIG. 6 is replaced by the pair of ball and spring check valves 650*a*, 650*b*. Such design may be particularly desirable for certain fluid applications such as highly corrosive fluids which may attack the flexible butterfly valve material. Other types of check valves may be employed such as a spring loaded butterfly check valve, a duckbill valve, or other suitable mechanisms.

Figure 29:
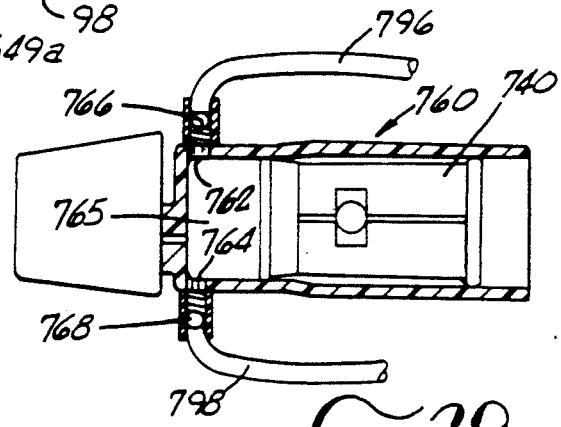
FIG. 29 is a cross sectional view of an alternate pump design having dual check valves externally connecting to the pump chamber.

FIG. 29 illustrates another alternate embodiment which has first and second tubings 796, 798 position externally to the cylinder chamber 765. The piston cylinder combination 740, 760 of FIG. 29 may include a conventional piston, or the piston 740 may be comprised of a multi-passage configurations such as a two passage configuration previously described. Therefore in this embodiment two or more independent fluid passages may be readily connected to the pumping chamber 765. In order to minimize the volume of mixed of fluid upstream of the pump chamber 765, the check valves 766, 768 are preferably positioned immediately adjacent the pump chamber 765. The entry openings 762, 764 are positioned to near the exit of the pump chamber 765 to facilitate even pump suction. By positioning the check valves and various fluid passages adjacent to the pump chamber 765, pre-mixing of fluids is minimized thereby improving the reliability that the desired concentration of mixed fluid will be dispensed.

FIG. 30 illustrates another alternate embodiment for a piston 840 and cylinder 860 combination. In this embodiment, the fluid passages 896, 898 pass through check valves 866, 868, respectively, after which the two passages join together at a "Y" or "T" connector 837 before connecting to the nipple portion 848 of the piston 840. The "Y" connector 837 is positioned adjacent piston 840 and cylinder 860, and the length of the internal passage 842 of the piston 840 is preferably minimized in order to minimize the amount of mixed fluid upstream of the pump chamber 865. Alternately the check valves 866, 868 may be incorporated within the piston 840 itself in a similar fashion to the embodiment of FIG. 29 and the "Y" connector being included within the piston 840 itself.

FIG. 31 illustrates another alternative embodiment in which the fluid passages 996 and 998 are external to the piston 940 and cylinder 960 combination. The fluid passages 996 and 988 connect to check valves 996 and 998 respectively and then combine at a "Y" connector 937 which is connected by fluid line 938 to a passage 962 in the side wall of the pump chamber 965. Again it is desireable that the volume of fluid in the passages downstream of the check valves 966, 968 and upstream of the pump chamber 965, including the length of the fluid line 938, be minimized to minimize the volume of mixed fluid upstream of the pump chamber 965. Volume of mixed fluid upstream of the pump chamber 965 is also minimized by positioning the "Y" connector 937 adjacent the pump chamber 965.

Though not illustrated, a mixing device, such as an in-line static mixer, may be incorporated in any of the embodiments to enhance mixing of the fluids. By way of example, in the embodiment of FIG. 31, an in-line static mixer may be suitably located in fluid line 938 between "Y" connector 937 and the pump chamber 965.

Another advantage of minimizing upstream mixing volume may be in an application where the dispensed fluid is activated upon mixing of the two fluids. In the instance where the mixed fluid has a very short activated life after mixing, the preferred designs minimize the amount of old fluid mixture which must be expelled before a new fresh mixture may be dispensed.

FIG. 32 illustrates an alternative metering device comprised of an orifice 510 disposed in the base 516 of the tube retainer piece 550. The fluid entering from the bottle (not shown) through passage 582 in the nipple 580 is metered through the orifice 510 before entering into the tubing 596. The orifice 510 is designed to permit a given flow so that a desired concentration may be provided for the fluid mixture. The nipple 580 includes an extension piece 584 for actuating the check valve within the bottle as in previous embodiments. Though not shown, the device may alternately include an additional check valve which may for example be disposed in passage 582 to prevent backflow of fluid out through the nipple 580 when the bottle is removed. Alternately, the orifice may comprise a tubing 596 having a desired inner diameter.

For a positive displacement pump such as employed by this design to properly function, check valves must be positioned both upstream and downstream of the pumping chamber. As set forth in the previously described embodiments, the tip seal 180 serves the function of a downstream check valve. Other types of check valves may be employed such as the ball check illustrated in FIG. 33. In this embodiment the fluid in pump chamber 65 exits through passage 663 and enters nozzle chamber 666. The spring 682 urges a ball 684 against a sealing surface 664 which seals off the passage 663 during filling of the pumping chamber 665. A modified tip seal portion 680 is positioned on the other side of spring 682 serving certain of the same functions as the tip seal of the previous embodiment.

Alternate nozzle configurations may be employed such as eliminating the tip seal portion or providing other check valve devices. For example, the tip seal 186 may be divided into two portions connected by a spring there between providing a spring loaded effect for sealing off the chamber 163. Other known rotating nozzle configurations may also be used eliminating the need for the swirl chamber portion of the tip seal 180. Preferred embodiments including the use of the tip seal provide for minimization of the volume of fluid downstream of the pumping chamber 165, 865 for advantages such as those previously described other designs.

FIGS. 34–36 illustrate details of the design of bottle connection mechanism of FIGS. 2–3 in which the connectors **226*a* and 226*b* and collar retainer piece 73 are designed with particular configurations to permit selective connections. The connectors or protruding ears 226*a* and 226*b* extend outwardly on opposite sides of the neck portion 222 of bottle 220. The cutout 74 in the bottle retaining piece 73 is generally rectangular in shape to correspond to the overall shape of the ears 226*a*, 226*b*. When the cutout 74 is rotated 90 degrees by actuation of handle 72, the bottle 220** is locked in place.

Other collar designs may be employed, but it is conceivable that a user may have similar spray bottles for different applications. For example, one sprayer may be used for household cleaning and another sprayer combination may include a insecticide. It would be undesirable for a bottle of insecticide to be connected to the sprayer head which was intended for household cleaning. To prevent connection of the wrong product to the sprayer head, the design of FIGS. 37–39 illustrate a collar connector comprising three ears **526*a*, 526*b*, 526*c* spaced about the throat 522 of the bottle 520. The collar connector piece 573 in the sprayer head has three corresponding cutouts 574*a*, 574*b*, 574*c* into which the corresponding ears may be inserted into place. The bottle 520 may then be locked in place by rotating the handle 572. It should be noted that the bottle 20 of FIG. 35 cannot fit into the connector 573 of FIG. 39 and the bottle 520 of FIG. 38 cannot fit into the connector 73 of FIG. 36**. Other collar connection configurations may be employed such as notches, protrusions or other suitable designs to provide a variety of different configurations so that the desired bottle will only fit on the intended sprayer head.

Thus, embodiments of a multiple fluid dispensing apparatus and bottle design have been shown and described. Though certain examples and advantages have been disclosed, further advantages and modifications may become obvious to one skilled in the art from the disclosures herein. The invention therefore is not to be limited except in the spirit of the claims that follow.

I claim:

1. A fluid dispensing apparatus for mixing and dispensing a first fluid from a first chamber and a second fluid from a second chamber, comprising:

a fluid dispensing head, including (a) a discharge outlet, (b) a pump chamber, (c) pumping means for (i) drawing fluid from the first and second chambers into the pump chamber at a desired fluid ratio and (ii) discharging fluid out the pump chamber to the discharge outlet, and (d) actuation means for actuating the pumping means, wherein during actuation of the pumping means, volume of the pump chamber is reduced forcing fluid from the pump chamber out through the discharge outlet such that substantially all the fluid in the pump chamber is discharged out the discharge outlet;

a first fluid passage providing fluid communication for the first fluid from the first chamber to the pump chamber; and a second fluid passage providing fluid communication for the second fluid from the second chamber to the pump chamber, the second fluid passage being independent from the first fluid passage.

2. A fluid dispensing apparatus according to claim 1 further comprising means for controlling the desired fluid ratio of first and second fluids entering the pump chamber.

3. A fluid dispensing apparatus according to claim 2 wherein the means for controlling comprises a metering device associated with the first fluid passage.

4. A fluid dispensing apparatus according to claim 3 wherein the metering device comprises an orifice disposed in the first fluid passage.

5. A fluid dispensing apparatus according to claim 1 wherein the fluid dispensing apparatus is a handheld sprayer having first and second bottles comprising the first and second chambers, the first and second bottles being constructed and arranged in a side-by-side relationship to one another and releasably attachable to the fluid dispensing head.

6. A fluid dispensing apparatus according to claim 5 wherein said first bottle and said second bottle are constructed and arranged to be separate from each other.

7. A fluid dispensing apparatus according to claim 1 further comprising a third fluid passage for providing fluid communication for a third fluid from a third chamber to the pump chamber.

8. A fluid dispensing apparatus according to claim 1 further comprising means for minimizing amount of mixed fluid upstream of the pump chamber.

9. A fluid dispensing apparatus for mixing and dispensing a first fluid from a first chamber and a second fluid from a second chamber, comprising:

a fluid dispensing head, including (a) a fluid outlet, (b) a pump chamber, (c) pumping means for (i) drawing fluid from the first and second chambers into the pump chamber at a desired fluid ratio and (ii) discharging fluid out the pump chamber to the fluid outlet, and (d) actuation means for actuating the pumping means, wherein actuation of the pumping means forces fluid from the pump chamber out through the fluid outlet;

a first fluid passage providing fluid communication for the first fluid from the first chamber to the pump chamber;

a second fluid passage providing fluid communication for the second fluid from the second chamber to the pump chamber, the second fluid passage being independent from the first fluid passage; and means for controlling the desired fluid ratio of first and second fluids entering the pump chamber, the means for controlling comprising a metering device associated with the first fluid passage, wherein the metering device comprises an axially translatable flow restriction device.

10. A fluid dispensing apparatus for mixing and dispensing a first fluid from a first chamber and a second fluid from a second chamber, comprising:

a fluid dispensing head, including (a) a fluid outlet, (b) a pump chamber, (c) pumping means for (i) drawing fluid from the first and second chambers into the pump chamber at a desired fluid ratio and (ii) discharging fluid out the pump chamber to the fluid outlet, and (d) actuation means for actuating the pumping means, wherein actuation of the pumping means forces fluid from the pump chamber out through the fluid outlet;

a first fluid passage providing fluid communication for the first fluid from the first chamber to the pump chamber; and a second fluid passage providing fluid communication for the second fluid from the second chamber to the pump chamber, the second fluid passage being independent from the first fluid passage, wherein the pumping means comprises a piston and cylinder combination, the piston including first and second internal passages for providing the fluid communication between the respective fluid passage and the pump chamber.

11. A fluid dispensing apparatus according to claim 10 further comprising a first one-way valve operative with the first internal passage and a second one-way valve operative with the second internal passage.

12. A fluid dispensing apparatus according to claim 11 wherein the first and second one-way valves comprise ball and spring check valves disposed in the respective internal passages.

13. A fluid dispensing apparatus according to claim 11 wherein the first and second one-way valve comprise flapper valves disposed on a front face of the piston.

14. A fluid dispensing apparatus for mixing and dispensing a first fluid from a first chamber and a second fluid from a second chamber, comprising:

a fluid dispensing head, including (a) a fluid outlet, (b) a pump chamber, (c) pumping means for (i) drawing fluid from the first and second chambers into the pump chamber at a desired fluid ratio and (ii) discharging fluid out the pump chamber to the fluid outlet, and (d) actuation means for actuating the pumping means, wherein actuation of the pumping means forces fluid from the pump chamber out through the fluid outlet;

a first fluid passage providing fluid communication for the first fluid from the first chamber to the pump chamber;

a second fluid passage providing fluid communication for the second fluid from the second chamber to the pump chamber, the second fluid passage being independent from the first fluid passage; and externally operable ratio adjustment means for selectively varying relative amounts of first and second fluids entering the pump chamber.

15. A fluid dispensing apparatus according to claim 14 further comprising a discharge nozzle through which fluid exits the dispensing head, a one-way valve disposed adjacent the fluid outlet for controlling passage of fluid therethrough, and a passageway between the fluid outlet and the discharge nozzle.

16. A fluid dispensing apparatus according to claim 14 wherein the ratio adjustment means provides for continuous adjustment of flow therethrough.

17. A fluid dispensing apparatus for mixing and dispensing a first fluid from a first chamber and a second fluid from a second chamber, comprising:

a fluid dispensing head, including (a) a fluid outlet, (b) a pump chamber, (c) pumping means for (i) drawing fluid from the first and second chambers into the pump chamber at a desired fluid ratio and (ii) discharging fluid out the pump chamber to the fluid outlet, and (d) actuation means for actuating the pumping means, wherein actuation of the pumping means forces fluid from the pump chamber out through the fluid outlet;

a first fluid passage providing fluid communication for the first fluid from the first chamber to the pump chamber; and a second fluid passage providing fluid communication for the second fluid from the second chamber to the pump chamber, the second fluid passage being independent from the first fluid passage, wherein the pump chamber is positioned immediately adjacent the fluid outlet for minimizing the amount of mixed fluid remaining in the fluid dispensing head after actuation of the pumping means.

18. A fluid dispensing apparatus, comprising:

a first chamber adapted to contain a first fluid;

a second chamber adapted to contain a second fluid;

a fluid dispensing head, including (a) a discharge outlet, (b) a pump chamber, (c) pumping mechanism for (i) drawing fluid from the first and second chambers into the pump chamber at a desired fluid ratio and (ii) discharging fluid out the pump chamber to the discharge outlet, and (d) actuator for actuating the pumping mechanism, wherein during actuation of the pumping mechanism, volume of the pump chamber is reduced forcing fluid from the pump chamber out through the discharge outlet such that essentially all the fluid in the pump chamber is discharged out the discharge outlet;

a first fluid passage providing fluid communication for the first fluid from the first chamber to the pump chamber; and a second fluid passage providing fluid communication for the second fluid from the second chamber to the pump chamber, the second fluid passage being independent from the first fluid passage.

19. A fluid dispensing apparatus according to claim 18 wherein the fluid dispensing apparatus is a handheld sprayer wherein the first and second chambers comprise first and second bottles, the first and second bottles being constructed and arranged in a side-by-side relationship to one another and releasably attachable to the fluid dispensing head.

* * * * *